United States Patent [19]

Mixon

[11] Patent Number: 4,688,635

[45] Date of Patent: Aug. 25, 1987

[54] APPARATUS FOR SETTING A BOTTOM TOOL

[76] Inventor: Ronald M. Mixon, 700 Levron St., Apt. 7-A, Houma, La. 70360

[21] Appl. No.: 739,113

[22] Filed: May 30, 1985

[51] Int. Cl.[4] ..... E21B 33/16

[52] U.S. Cl. ..... 166/162; 166/68; 166/373

[58] Field of Search ..... 166/68, 107, 166, 319, 166/373, 374; 73/40.5 R, 49.1

[56] References Cited

U.S. PATENT DOCUMENTS

| | | | |
|---|---|---|---|
| 4,374,543 | 2/1983 | Richardson | 166/317 X |
| 4,378,050 | 3/1983 | Tatevosian | 166/164 X |
| 4,526,228 | 7/1985 | Wynn | 166/66 X |

*Primary Examiner*—Stephen J. Novosad
*Assistant Examiner*—Thomas J. Odar
*Attorney, Agent, or Firm*—George A. Bode

[57] ABSTRACT

An apparatus for setting a bottom tool comprising a valve body having its lower end portion connected to a bottom tool and an upper end portion connected to a source of fluid under pressure, an elongated bore within the valve body, a valve member slidable within the bore and having a piston exposed to the fluid under pressure movable from a first position whereby the application of the fluid under predetermined pressure imparts longitudinal movement to the valve member to a second position whereby the valve member transmits the force of the fluid under pressure to the bottom tool, seals provided on said piston for preventing the fluid exerting pressure against said piston from flowing through the bore of said valve, and a packing medium provided in the bore intermediate the piston and the lower end portion of the valve body.

1 Claim, 2 Drawing Figures

APPARATUS FOR SETTING A BOTTOM TOOL

BACKGROUND OF THE INVENTION

1. Field of the Invention

The present invention generally relates to an apparatus for testing in down hole oilfield applications, and, more particularly to an apparatus for attaching to a sub or "bottom hole" tool so that the application of contaminated fluid such as water under pressure directly to the bottom tool can be forsaken.

2. General Background

In offshore oil and gas drilling the present state of the art requires a "bottom hole" tool or "bottom" tool be placed in a bore hole such that it can expand and contract based upon fluid pressure (usually water) being applied to an inlet port at the top thereof. The apparatus of the present invention is provided for threadable attachment to such "bottom hole" tool so that the application of the fluid pressure directly to the "bottom hole" tool can be obviated.

Several attempts have been made in the prior art to develop testing tools that are designed to test a tubing as the tubing string is being made up and positioned in a well bore.

The following U.S. patents show testing devices that are lowered down a pipe in a well on a string to apply pressure to test the pipe or casing:

U.S. Pat. No. 4,474,055
U.S. Pat. No. 3,108,467
U.S. Pat. No. 4,083,230
U.S. Pat. No. 3,071,960
U.S. Pat. No. 3,800,596
U.S. Pat. No. 3,899,920
U.S. Pat. No. 4,081,990
U.S. Pat. No. 3,396,575

SUMMARY OF THE INVENTION

An object of the present invention is to provide an apparatus for setting a bottom tool comprising: a valve body having a bore therethrough connected to a bottom tool at its lower end and means for supplying a fluid under pressure at its upper end, the valve body having a valve member slidable within the bore and having a piston thereon exposed to the fluid under pressure, the valve member being movable from a first position whereby the application of the fluid under a predetermined pressure imparts longitudional movement to the valve member to a second position whereby the valve member transmits the force of the fluid under pressure to the bottom tool.

Another object of the present invention is to provide a means for preventing the fluid exerting pressure against the piston from flowing through the valve to the bottom tool.

It is a further object of the present invention to provide a fluid packing medium intermediate the piston and the lower end portion of the valve body.

BRIEF DESCRIPTION OF THE DRAWINGS

For a further understanding of the nature and objects of the present invention, reference should be had to the following detailed description taken in conjunction with the accompanying drawings, in which like parts are given like reference numerals and, wherein.

DETAILED DESCRIPTION OF THE PREFERRED EMBODIMENT

Figures 1, 2:
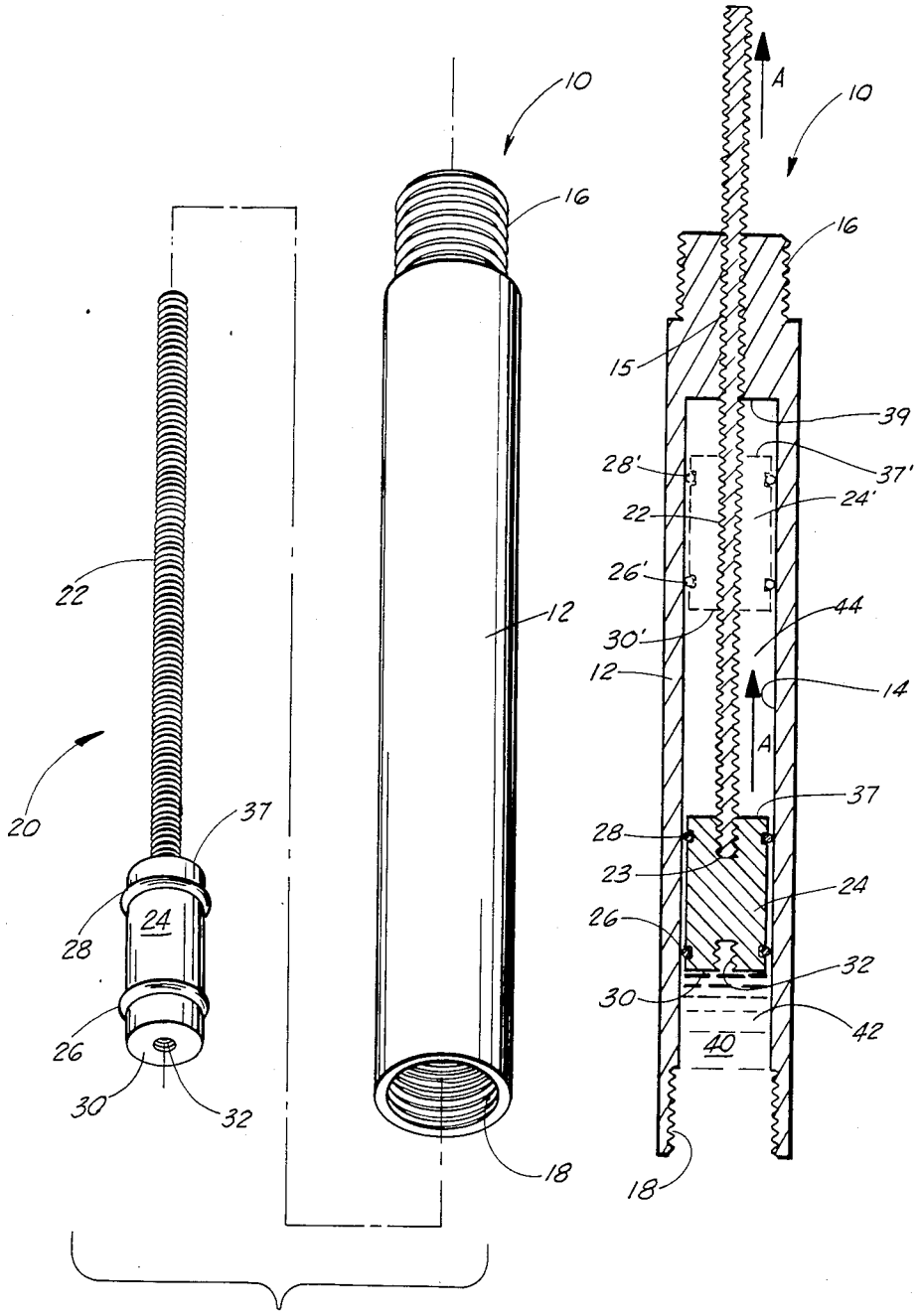
FIG. 1 is a longitudinal sectional view of the apparatus of the preferred embodiment of the present invention.
FIG. 2 is an exploded view of the preferred embodiment of the apparatus of the present invention.

FIGS. 1 and 2 illustrate the preferred embodiment of the apparatus of the present invention designated generally by the numeral 10 which is comprised of a valve body 12 having central bore 14 provided longitudinally therethrough. Upper end 16 of valve body 12 is an externally threaded male end or "pin" end which is threadably coupled with the female or "box" end of another device (not shown) for providing fluid pressure to bore 14. Apparatus 10 is generally associated with "down hole" operations in oil and gas well drilling operations. The present state of the art requires that apparatus 10 be connected at its lower internally threaded or "box" end 18 to a "bottom" tool or "sub" which is placed in a well bore so that it can expand and contract based on fluid pressure provided to an inlet port at the top thereof. To eliminate the direct application of fluid pressure (usually contaminated water) to the "bottom"tool apparatus 10 is provided. Thus apparatus 10 at "pin" end 16 thereof is connected to a source of fluid under pressure (not shown).

To prevent the direct application of such contaminated fluid under pressure to "bottom" tool through bore 14 of apparatus 10 valve member 20 is slidably mounted within bore 14. Valve member 20 has a piston 24 threadably connected to an elongated stem 22 at threaded groove 23. A pair of 0-ring seals 26, 28 are provided in spaced-apart annular grooves in piston 24. Piston 24 is further provided with piston face 30 and a second threaded groove 32 therein. Valve member 20 is mounted within longitudinal bore 14. of valve body 12 in the manner best illustrated in FIG. 1 such that valve stem 22 is slidably received in reduced diameter portion 15 of bore 14 and 0-ring seals 26, 28 on piston 24 sealingly engage the walls of bore 14 for isolating chamber 40, formed between piston face 30 and the "bottom" tool inlet (not shown), from chamber 44, formed between the upper piston face 37 and shoulder 39 of valve body 12. Preparatory to inserting valve member 20 in bore 14 of valve 12, a packing medium 42 such as grease or other lubricants is provided at end 18 of valve body 12 and as stem 22 and therefore piston 24 is moved in the direction of ARROWS A to the phantom position 24' of FIG. 1 packing medium 42 is drawn into chamber 40 of bore 14 by suction. Thus chamber 40 is enlarged and chamber 44 reduced in size and chamber 40 is filled with packing medium 42. Stem 22 can then be threadably removed from piston 24.

With apparatus 10 in the assembled condition of FIG. 1, lower end or "box" end 18 is threadably connected to the "bottom" tool (not shown) in the well bore and upper or "pin" end 16 is threadably connected to a source of fluid under pressure (not shown).

In operation, when fluid pressure is provided to bore 14 through "pin" end 16 and bore 15 and then into bore 14 by the source of such fluid under pressure, the pressure acting on the surface area of face 37 of piston 24 creates a force in the direction opposite ARROWS A and imparts movement of the piston 24 in the same (longitudinal) direction. With such movement in the direction opposite ARROWS A imparted to piston 24 it forces the packing medium 42 in chamber 40 to displace eventually through "box" end 18 of valve body 12 and contacts the "bottom" tool transmitting the force of the fluid under pressure thereto. Seal rings 26, 28 are such as to sealingly engage the internal surface of valve body 12 and thus isolate the test fluid under pressure in chamber 44 between the upper end 16 of valve body 12 and piston face 37. With piston 24 forced by the fluid under pressure in the direction opposite ARROWS A from the phantom position 24' of FIG. 1 to the position 24 of FIG. 1, packing medium 42 will be displaced the necessary volume through the space between piston face 30 and "box" and 18 to the "bottom" tool for lubrication thereof. Valve piston 24 will be returned from the position of FIG. 1 in the direction of ARROWS A to the phantom position of FIG. 1 when the "bottom" hole pressure acting on valve piston 24 overcomes the force of the fluid under pressure provided bore 14 through end 16 thus resetting apparatus 10 for a repetition of the operation described above by threadably reinserting stem 22 in groove 23.

Thus the apparatus 10 of the present invention prevents leakage of the fluid under pressure applied down hole (normally containing water) to the "bottom" hole tool thus preventing rusting and other operational problems down hole.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed this invention is:

1. An apparatus for setting a bottom tool, comprising:

(a) an elongated valve body having its lower end portion threadably connected to a bottom tool and an upper end portion threadably connected to a means for supplying fluid under pressure;

(b) an elongated longitudinal bore within said valve body;

(c) a retrievable valve stem received in an enlarged portion of said bore having a valve member threadably connected thereto, said valve member slidable within said bore and having a first piston face exposed to said fluid under pressure, said valve member movable from a first position whereby the application of said fluid under a predetermined pressure to said first piston face imparts longitudinal movement to said valve member to a second position whereby said valve member transmits the force of said fluid under pressure to said bottom tool;

(d) means for preventing said fluid exerting pressure against said first piston face from flowing through said bore of said valve; and (e) packing medium provided in said bore intermediate said piston and said lower end portion of said valve body, said valve body thereby having a second piston face exposed to said packing medium, said packing medium seperated from said fluid under pressure by said preventing means and displacing through said lower end portion of said valve body when said first piston face is exposed to said predetermined pressure, thereby transmitting said force to said bottom tool.

* * * * *